US008944981B2

(12) United States Patent
Ho et al.

(10) Patent No.: US 8,944,981 B2
(45) **Date of Patent: *Feb. 3, 2015**

(54) MULTI-DIMENSIONAL ABDOMEN EXERCISE MACHINE

(71) Applicants: Wei-Teh Ho, Taipei (TW); Willy Ho, Taipei (TW)

(72) Inventors: Wei-Teh Ho, Taipei (TW); Willy Ho, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/938,115

(22) Filed: Jul. 9, 2013

(65) Prior Publication Data

US 2014/0100088 A1 Apr. 10, 2014

Related U.S. Application Data

(63) Continuation-in-part of application No. 13/646,414, filed on Oct. 5, 2012.

(51) Int. Cl.

| | |
|---|---|
| ***A63B 26/00*** | (2006.01) |
| ***A63B 21/00*** | (2006.01) |
| ***A63B 21/068*** | (2006.01) |
| ***A63B 23/02*** | (2006.01) |

(52) U.S. Cl.

CPC ..... *A63B 23/0227* (2013.01); *A63B 23/0211* (2013.01)

USPC ..... 482/142; 482/96; 482/132; 482/140

(58) Field of Classification Search

USPC ..... 482/134–147, 71, 95, 96, 131, 132

See application file for complete search history.

(56) References Cited

U.S. PATENT DOCUMENTS

| | | | | |
|---|---|---|---|---|
| 4,679,786 | A * | 7/1987 | Rodgers | 482/70 |
| 4,846,465 | A * | 7/1989 | Iams et al. | 482/132 |
| 6,440,045 | B1 * | 8/2002 | Gaston | 482/140 |
| 7,662,076 | B1 * | 2/2010 | Ho | 482/130 |
| 7,780,585 | B1 * | 8/2010 | Rivas | 482/140 |
| 8,545,373 | B2 * | 10/2013 | Borden | 482/91 |
| 8,814,763 | B2 * | 8/2014 | Ho et al. | 482/96 |
| 2010/0234776 | A1 * | 9/2010 | Borden | 601/33 |
| 2013/0123083 | A1 * | 5/2013 | Sip | 482/145 |
| 2014/0005008 | A1 * | 1/2014 | Ho et al. | 482/96 |
| 2014/0031175 | A1 * | 1/2014 | Peralo | 482/66 |

* cited by examiner

*Primary Examiner* — Oren Ginsberg
*Assistant Examiner* — Megan Anderson
(74) *Attorney, Agent, or Firm* — Blakely Sokoloff Taylor Zafman LLP

(57) ABSTRACT

An exercise machine applicable for strengthening a user's abdominal muscles is described. The exercise machine can include a track frame having a higher end and a lower end. Kneeling assemblies may be mounted on parallel gliding rails of the track frame to receive the knees from a user to make movements up and down between the lower end and the higher end of the track frame. Each kneeling assembly may be engaged with a pair of the gliding rails. A rotationally adjustable armrest holder may be adjustable rotationally mounted on the upper end of the track frame. The armrest holder can be oriented towards a direction having an angular relationship with an axis of the track frame between the lower end and the higher end. The armrest holder may capable of supporting the arms of the user making the movements with a twisting effect according to the angular relationship.

16 Claims, 8 Drawing Sheets

MULTI-DIMENSIONAL ABDOMEN EXERCISE MACHINE

CROSS-REFERENCE TO RELATED APPLICATIONS

The present application is a continuation-in-part of, and claims the benefit of U.S. patent application Ser. No. 13/646,414, filed on Oct. 5, 2012, entitled "MULTI-DIMENSIONAL ABDOMEN EXERCISE MACHINE", which is hereby incorporated by reference in its entirety into this application

FIELD OF INVENTION

The present invention relates generally to physical training machines, and in particular, exercise machines structured for exercising the abdominal muscles of a user.

BACKGROUND

With the growing awareness of health problems caused by lack of exercise, popularity of exercising machines has been continuously increasing. Typically, these machines are designed to focus movements of specific parts of the body. For example, abdominal machines may be structured to induce body exercises to strengthen the abdominal muscles.

Existing abdominal machines, however, are usually designed based on variations of sit-ups exercises. Effective abdominal exercises may require a combination of movements involving muscles of different parts of the body including the waist, legs, etc. Although there are many exercising machines available for exercising different parts of the body, these multipurpose exercising machines are usually heavy and expensive devices. Further, these devices are often directed for a user to perform one dimensional exercise movements at a time.

Therefore, traditional abdomen machines are not effective to facilitate a user to exercise abdomen muscles in a multi dimensional manner.

SUMMARY OF THE DESCRIPTION

An exercise machine applicable for strengthening a user's abdominal muscles in a multi-dimensional manner (e.g. allowing rotational movements and back and forth line movements at the same time) can include a track frame having one or more elongated gliding rails extended between a higher end and a lower end of the track frame. One or more kneeling assemblies can be movably mounted on the elongated gliding rails to receive the knees from a user to make movements up and down between the lower end and the higher end of the track frame along the elongated gliding rails. The kneeling assemblies may be configurable to move together or separately along the elongated gliding rails. A rotationally adjustable armrest holder may be mounted on the upper end of the track frame. The armrest holder can be oriented towards a direction having an angular relationship with an axis of the track frame between the lower end and the higher end. The armrest holder may be capable of supporting the arms of the user who is making up and down exercise movements with a twisting effect according to the angular relationship.

In another embodiment, a track frame can have two pairs of elongated gliding rails arranged in parallel. The track frame can have a higher end and a lower end. A pair of gliding structures may be movably mounted separately on each pair of the gliding rails. The gliding structures can have kneeling pads capable of receiving knees from a user to make movements with the gliding structures gliding along the elongated rails. The kneeling pads may be adjustably oriented towards a first direction having a first angular relation with an axis of the track frame between the lower end and the higher end.

An armrest holder may be mounted, adjustable rotationally, on the upper end of the track frame. The armrest holder may be oriented towards a second direction having a second angular relationship with the axis or longitudinal direction of the track frame. The armrest holder may be capable of supporting arms of the user adding a twisting effect to movements along the elongated rails with a twisting effect according to the first and second angular relationships. A support frame may be coupled to the higher end of the track frame to provide support from a floor supporting the exercising machine. The support frame can cause the track frame to tilt upwards from the floor while the lower end of the track frame rests on the floor.

Other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The present invention is illustrated by way of examples and not limitations in the figures of the accompanying drawings, in which like references indicate similar elements and in which.

DETAILED DESCRIPTION

In the following description, numerous specific details are set forth, such as examples of external surfaces, named components, connections between components, etc., in order to provide a thorough understanding of the present invention. It will be apparent, however, to one skilled in the art that the present invention may be practiced without these specific details. In other instances, well known components or methods have not been described in detail but rather in a block diagram in order to avoid unnecessarily obscuring the present invention. Further specific numeric references such as first, second, third, etc., may be made. However, the specific numeric references should not be interpreted as a literal sequential order but rather interpreted as references to different objects. Thus, the specific details set forth are merely exemplary. The specific details may be varied from and still be contemplated to be within the spirit and scope of the present invention.

Reference in the specification to "one embodiment" or "an embodiment" means that a particular feature, structure, or characteristic described in connection with the embodiment can be included in at least one embodiment of the invention. The appearances of the phrase "in one embodiment" in various places in the specification do not necessarily all refer to the same embodiment.

Figure 1:
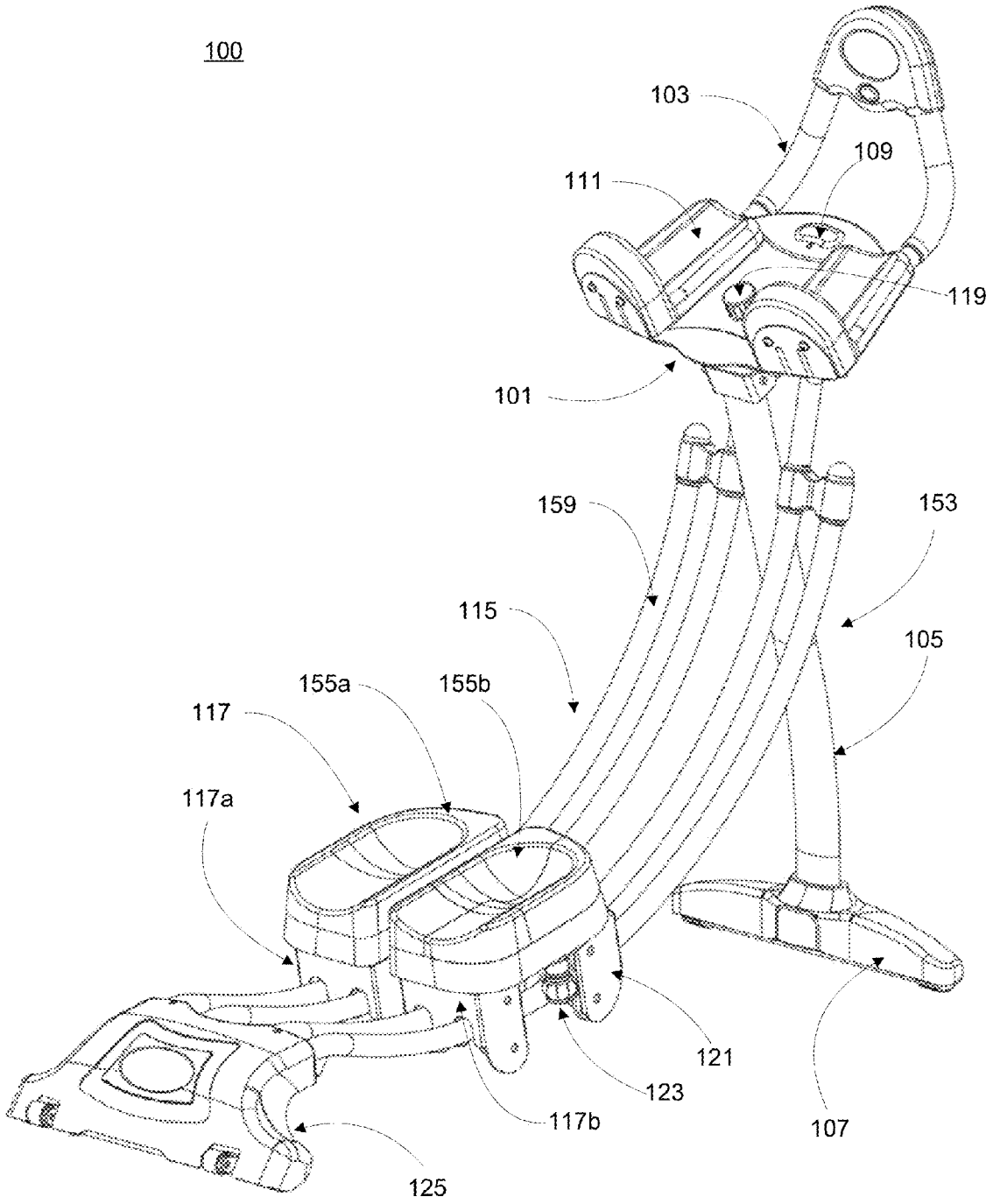
FIG. 1 is a perspective view of an embodiment of an exercise machine assembly.

FIG. 1 is a perspective view of an embodiment of an exercise machine assembly. Exercise machine (or device) 100 can include a track frame 115 having one or more elongated gliding rails 159. For example, gliding rails 159 may include a first pair and a second pair of elongated gliding rails disposed in parallel. Track frame 115 can have a higher end affixed with support frame 153 and a lower end having foot base 125 resting on a floor. Track frame 115 may be configured with one single gliding rail, two parallel gliding rails, or multiple parallel gliding rails to support gliding movements along the gliding rail(s) between the lower end and the higher end track frame. Support frame 153 may provide elevation from the floor for the higher end of track frame 115. In one embodiment, support frame 153 may include upright 105 standing upwardly on support base 107 resting on the floor. Gliding rails of track frame 115 and upright 105 may be attached with each other via a coupling rod.

Exercising machine 100 may include kneeling support 117 movably mounted on track frame 115. Parallel gliding rails of track frame 115 may extend between the higher and lower end of track frame 115 in a curved or straight manner. For example, the parallel gliding rails may be shaped concavely, convexly or in other applicable non-straight forms to allow movement of kneeling support 117 along the gliding rails in multiple dimensions.

Exercise machine 100 may include a rotationally adjustable armrest holder 101 mounted on the upper end of track frame 115 to support the arms of a user moving along track frame 115. Armrest holder 101 may be configured as a rotating disk orientable towards various directions to form different angular relationships with a longitudinal direction (e.g. along an axis between the higher end and the lower end) of track frame 115. For example, adjustment knob 119 may be provided to allow the user to adjust the amount of rotation needed for armrest holder 101. The possible amount of rotation may be selected from predetermined configurations, such as 0 degree rotation, left/right rotations between 10-60 degrees, or other applicable degrees of rotation. The angular relation may incite a twisting effect on a user using armrest holder 101 while making movements along track frame 115.

In some embodiments, armrest holder 101 may include handle bar 103 extended towards a front direction of armrest holder 101 to allow hand grabbing from a user of exercise machine 100. Armrest holder 101 may include two elbow pads 111 aligned with or extending handle bar 103 shaped to receive the elbows from the user grabbing handle bar 103. Armrest holder 101 may be equipped with display 109 to indicate amount of rotation configured for armrest holder 101 with respect to track frame 115. For example, display 109 may include a digital display device, such as LCD (Liquid Crystal Display) display or other applicable display mechanisms, to output an angular value indicating the angular relationship between the front direction of armrest holder 101 and the movement direction of kneeling support along a longitudinal axis of track frame 115.

In one embodiment, kneeling support 117 may include a first kneeling assembly 117*a* and a second kneeling assembly 117*b* movably mounted separately on gliding rails 159 of track frame 115. In some embodiments, each kneeling assembly 117*a*, 117*b* may be mounted on a pair of gliding rails 159, for example, to increase stability when moving. Alternatively, each kneeling assembly may be mounted along a single one of gliding rails 159. Exercise machine 100 may include only one kneeling assembly corresponding to, for example, a combination of kneeling assemblies 117*a*, 117*b*.

Kneeling support 117 may be capable of receiving the knees of a user using exercise machine 100 to make movements up and down between the lower end and the higher end of track frame 115. First kneeling assembly 117*a* and second kneeling assembly 117*b* may move (or glide) together or separately along the gliding rails of track frame 115 to allow the user to move two legs, each resting on separate kneeling assemblies 117*a*, 117*b*, together in one direction or separately in two opposite directions longitudinally along gliding rails of track frame 115.

Each kneeling assembly 117*a*, 117*b* may separately include rotationally adjustable kneeling pads 155*a*, 155*b*. For example, keeling assembly 117*a* may be affixed with kneeling pad 155*a* oriented toward a first direction forming a first angle with an axis of track frame 115. Keeling assembly 117*b* may affixed with kneeling pad 155*b* oriented toward a second direction forming a second angle with the axis of track frame 115. In one embodiment, the first and second angles may be substantially equal in size when kneeling pads 155*a*, 155*b* move in parallel together to provide an additional twisting effect on a user making the movement along track frame 115.

In one embodiment, kneeling assemblies 117*a*, 117*b* may include a coupling control mechanism to detachably couple kneeling assemblies 117*a*, 117*b* such that kneeling pads 155*a*, 155*b* can move in parallel oriented towards a common direction to cause the additional twisting effect. Alternatively, the coupling control mechanism may decouple kneeling assemblies 117*a*, 117*b* to allow each kneeling assembly to glide along separate gliding rails of track frame 115 in opposite directions.

Kneeling assemblies 117*a*, 117*b* may separately include mounting brackets movably mounted on corresponding gliding rails of track frame 115. For example, kneeling assembly 117*b* may include mounting bracket 121 and rotationally adjustable kneeling pad 155*b* attached to mounting bracket 121 via a surface of mounting bracket 121. As a result, kneeling pad 155*b* may rotate with respect to a rotation axis that is substantially perpendicular to the surface of mounting bracket 121.

In another embodiment, exercising machine 100 can include track frame 115 having a pair of two elongated gliding rails 159 in parallel. Track frame 115 may have a higher end and a lower end. Exercising machine 100 may include a pair of gliding structures 117*a*, 117*b* movably mounted on the gliding rails. Gliding structures 117*a*, 117*b* may include kneeling pads 155*a*, 155*b* capable of receiving the knees from a user to make movements with gliding structures 117*a*, 117*b* gliding along the rails. Kneeling pads 155*a*, 155*b* may be adjustably oriented towards a first direction forming a first angular relation with an axis, for example, between the lower end and the higher end of track frame 115.

Exercising machine 100 may include rotationally adjustable armrest holder 101 mounted on the upper end of track frame 115. Armrest holder 101 may be oriented towards a second direction forming a second angular relationship with the axis of track frame 115. In one embodiment, armrest holder may be capable of supporting the arms of the user adding a twisting effect to the movement along track frame 115 according to the first angular relationship via gliding structure 117 and the second angular relationship via armrest holder 101 with respect to the axis or a longitudinal direction of track frame 115. Support frame 153 may be coupled to the higher end of track frame 115 to provide support from the floor to cause track frame 115 to tilt upwards from the floor while the lower end of track frame 115 rests on the floor.

Figure 2:
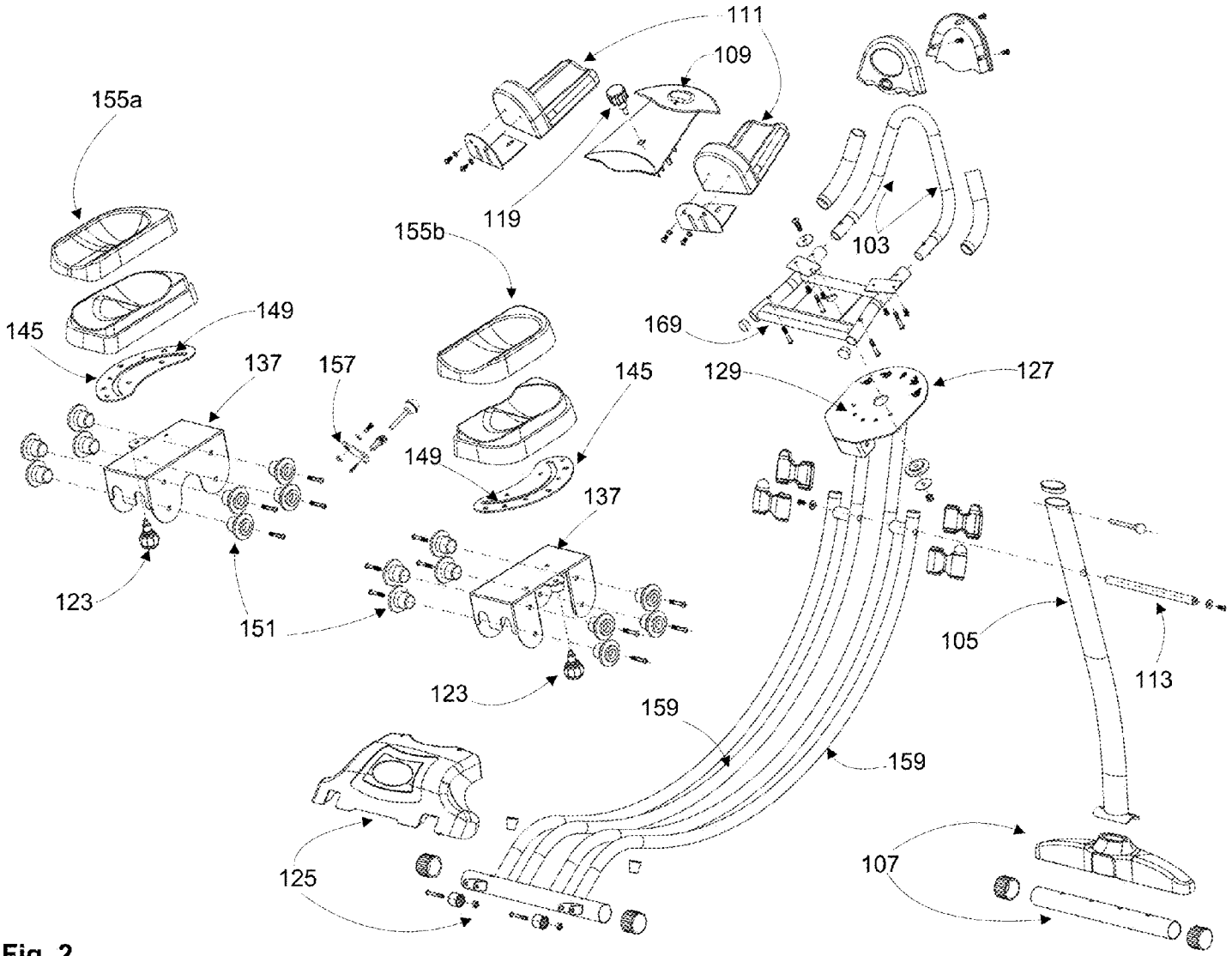
FIG. 2 is an exploded perspective view of an embodiment of an exercise machine assembly.
Figure 3A:
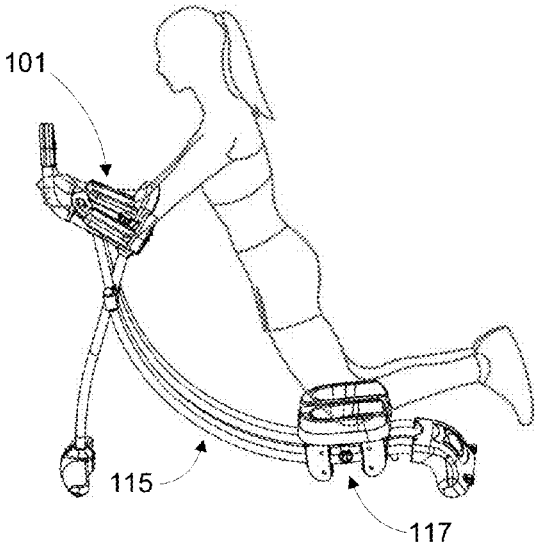
FIGS. 3-13 show examples of applications of the present invention.
Figure 3B:
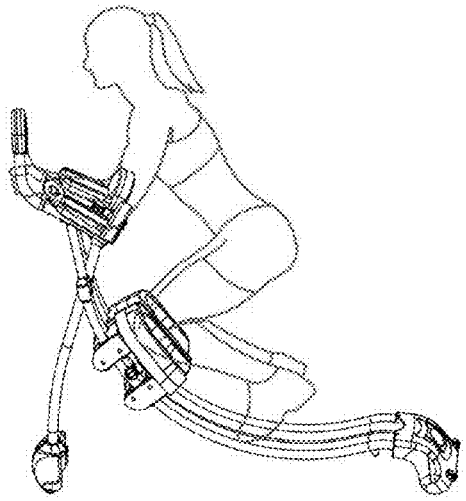
Figure 4A:
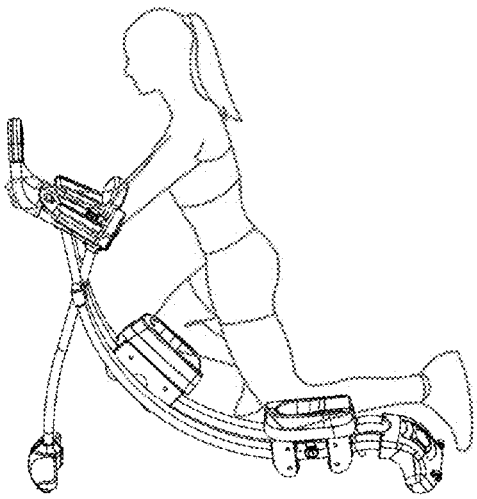
Figure 4B:
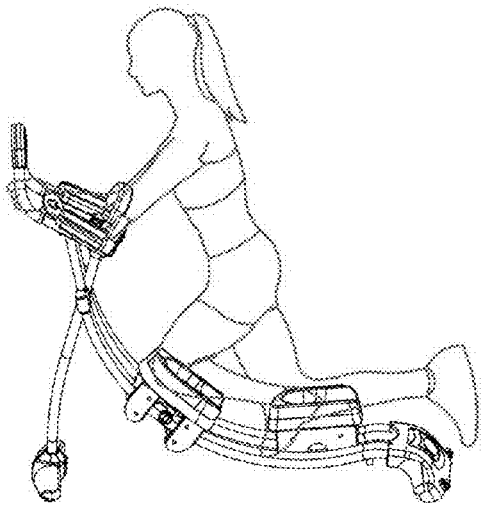

FIG. 2 is an exploded perspective view of an embodiment of an exercise machine assembly as shown in FIG. 1. For example, track frame 115 may include binding plate 127 fixedly attached to the gliding rails at the higher end of track frame 115. Rotational movement of an armrest holder, such as armrest holder 101 of FIG. 1, may be constrained along a surface corresponding to binding plate 127.

An armrest holder may include handle bar 103, elbow pads 111 and display 109 fixedly attached to mounting bracket 169. Adjustment knob 119 of an adjustment fastener may allow rotational adjustment of mounting bracket 169 around a center of binding plate 127. In some embodiments, binding plate 127 may be configured with multiple coupling holes 129, for example, equally spaced circularly (or via other applicable angular position arrangements) around the center of binding plate 127. The armrest holder may be secured to binding plate 127 with an adjustment fastener locked through one of coupling holes 129 via adjustment knob 119.

In one embodiment, the axis of track frame 115 and the orientation (or direction) of the armrest holder may form an angle over the surface of binding plate 127. Display 109 may indicate an angular value of the angle representing the orientation of the armrest holder. Possible orientations of the armrest holder may be pre-configured corresponding to multiple coupling holes 129 around the center of binding plate 127. An adjustment fastener with adjustment knob 119 may be fastened to one of coupling holes 129 to select a corresponding angle to orient the armrest holder with respect to the axis of track frame 115.

Kneeling assemblies, such as kneeling assemblies 117*a*, 117*b* of FIG. 1, can include slide bracket 137 attached with one or more wheels 151 slidably attachable to an elongated gliding rail 159 of track frame 115. For example, slide bracket 137 may be affixed with two sets of wheels 151, each set rollable along one of a pair of rails 159. Each rail may be engaged with the wheels along one or multiple sides (e.g. top and bottom sides) of the rail. A coupling control mechanism via control bracket 157 can fasten two slide brackets 137 to move together or separately along track frame 115.

In one embodiment, kneeling assembly can include kneeling pads 155*a*, 155*b* affixed with sliding brackets 137 via plates 145. Plates 145 may include curved tracks 149 which can be a hollow cut to allow rotational or curved position adjustment over slide brackets 137. For example, kneeling pads 155*a*, 155*b* may be attached to slide brackets 137 with adjustment knobs 123 which may be secured in positions along curved tracks 149 to rotate kneeling pads 155*a*, 155*b* to a desired direction.

FIGS. 3-13 show examples of applications of the present invention, for example, based on exercise machine 100 of FIG. 1. Turning now to FIGS. 3A-3B, armrest holder 101 may be aligned longitudinally with track frame 115. The user may hold on handle bars with arms and elbow resting on armrest holder 101. The user may kneel on kneeling pads of kneeling support 117 to cause up and down slide movements along the curvature of track frame 115. Alternatively, turning now to FIGS. 4A-4B, two kneeling pads of kneeling support may be decoupled to allow the user's legs to make alternative and separate movements along separate rails of track frame 115.

Figure 5A:
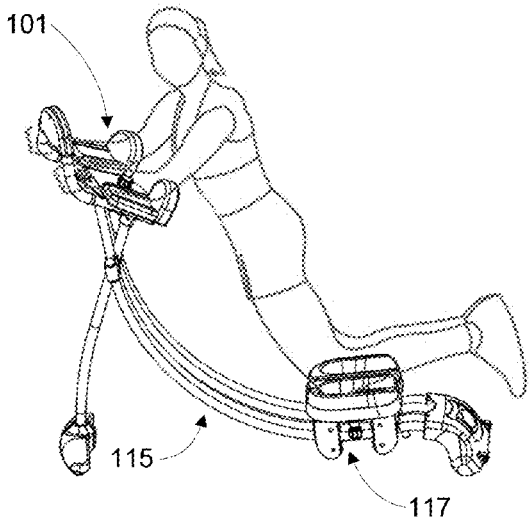
Figure 5B:
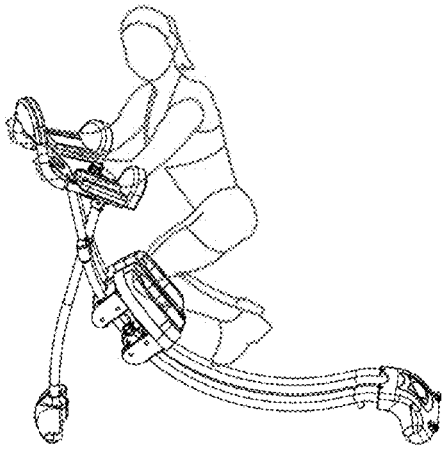
Figure 6A:
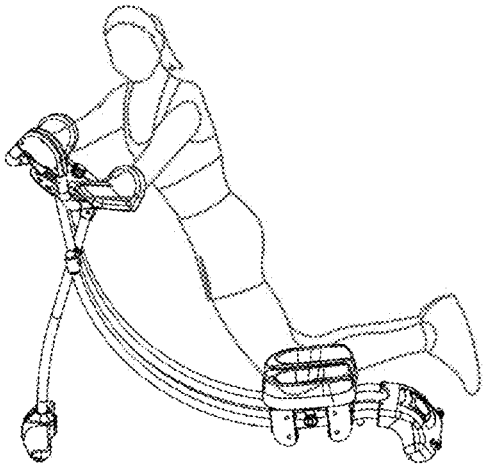
Figure 6B:
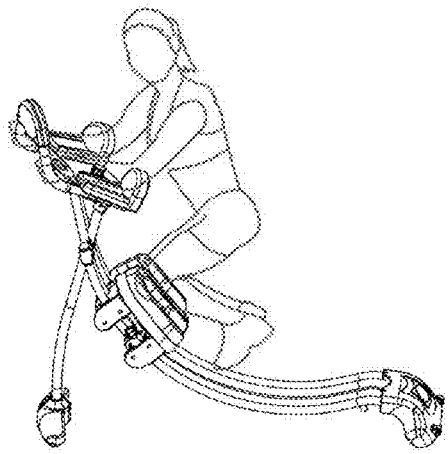
Figure 7A:
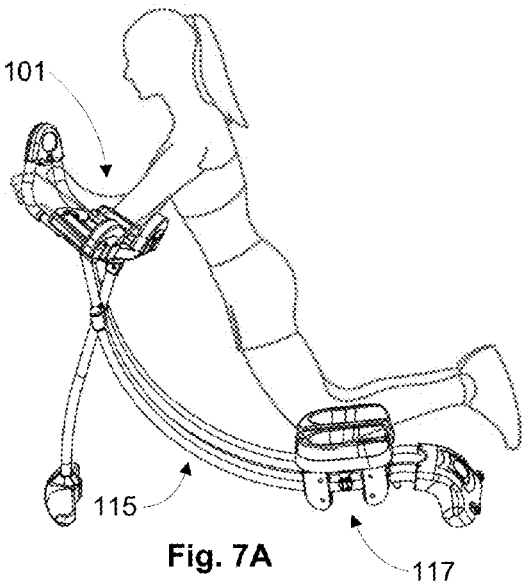
Figure 7B:
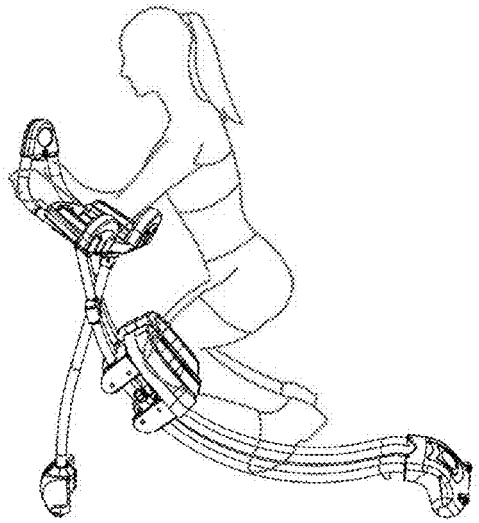
Figure 8A:
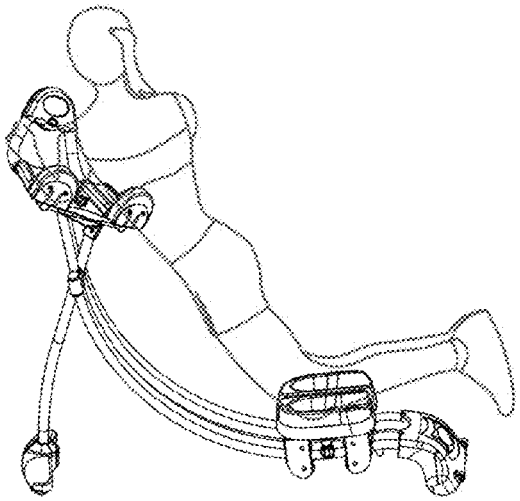
Figure 8B:
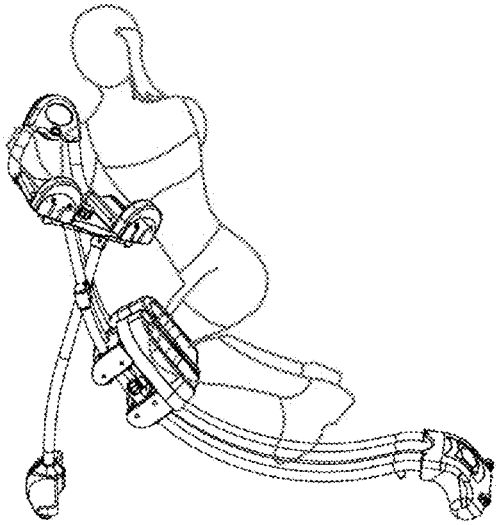

Turning now to FIGS. 5A-5B, armrest holder 101 may be rotated left to form an angular relationship with an intermediate size (e.g. 30 degrees) relative to the longitudinal direction of frame 115. The user may hold on handle bars with arms and elbow resting on armrest holder 101 to cause up and down slide movements along the curvature of track frame 115 to cause twisting effects via the upper body of the user. Alternatively, turning now to FIGS. 6A-6B, armrest holder 101 may be rotated further left to form a strong angular relationship with an size (e.g. 60 degrees) relative to the longitudinal direction of track frame 115 to increase the twisting effects while moving along the track frame. FIGS. 7A-7B and 8A-8B may show similar applications of an exercise machine as in FIGS. 5-6 with armrest holder 101 rotated to the right side.

Figure 9A:
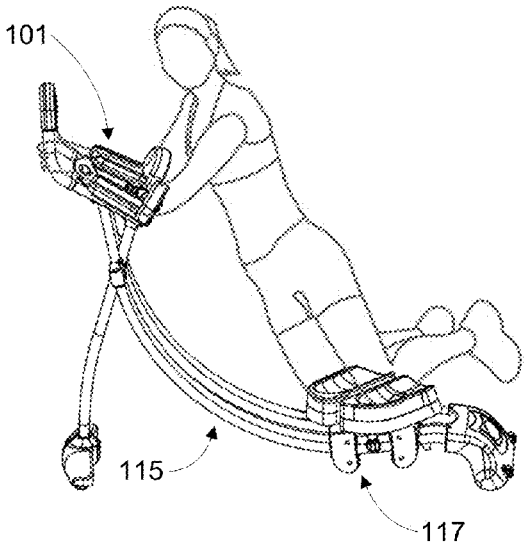
Figure 9B:
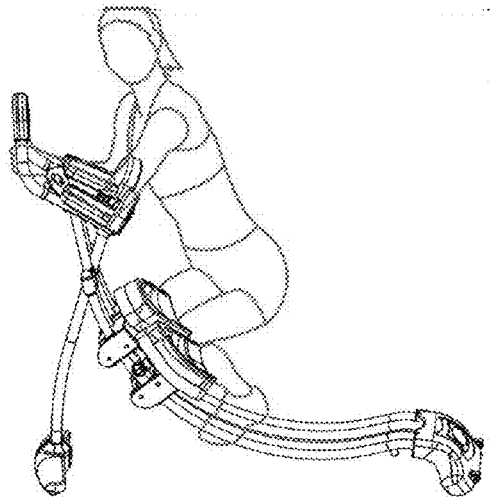

Turning now to FIGS. 9A-9B, armrest holder 101 may be substantially aligned longitudinally with track frame 115. The user may hold on handle bars with arms and elbow resting on armrest holder 101. Kneeling pads of kneeling support 117 may be rotated left to from an angular degree (e.g. 45 degree) with the longitudinal direction of track frame 115. The user may kneel on kneeling pads to cause up and down sliding or gliding movements along the curvature of track frame 115 with the kneeling pads rotated to cause twisting effects via the lower body of the user.

Figure 10A:
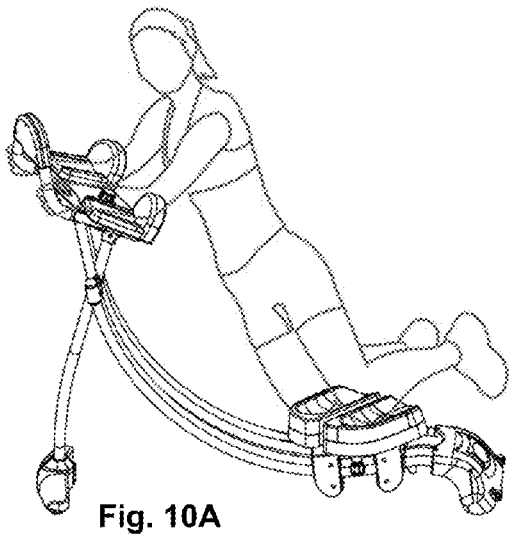
Figure 10B:
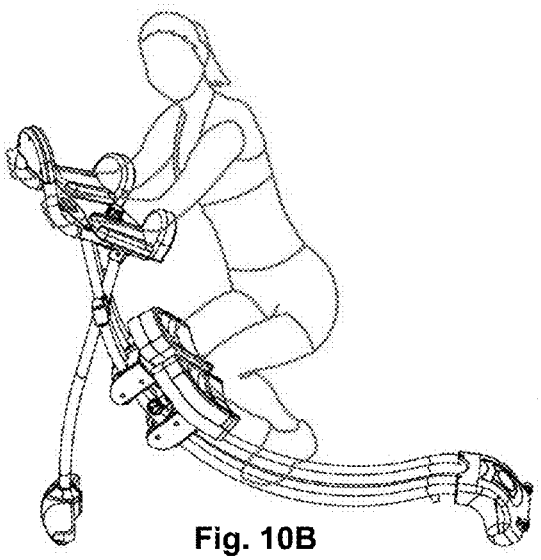
Figure 11A:
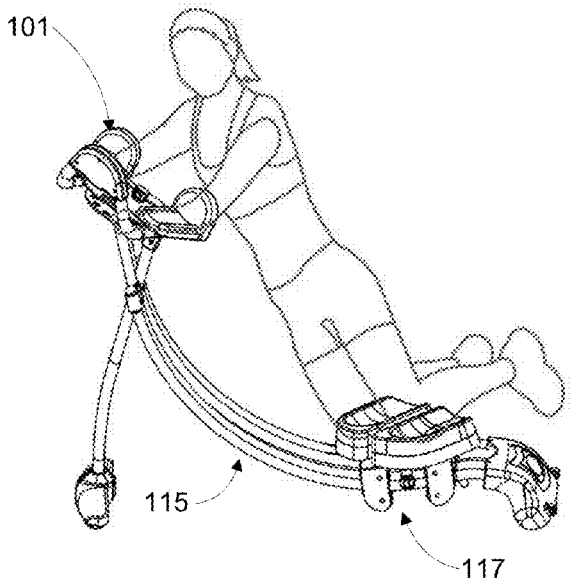
Figure 11B:
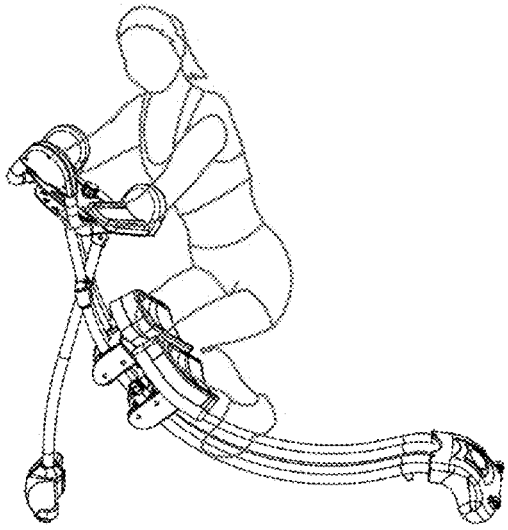
Figure 12A:
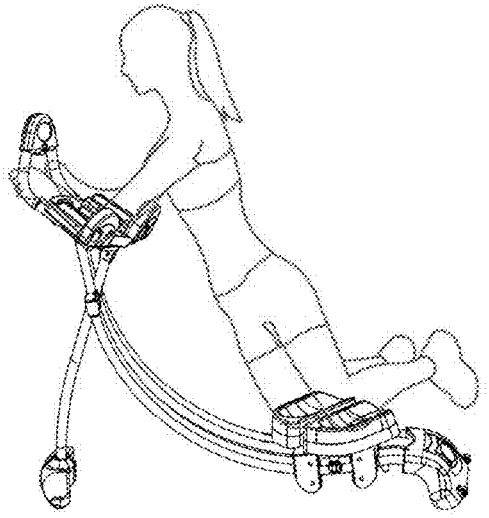
Figure 12B:
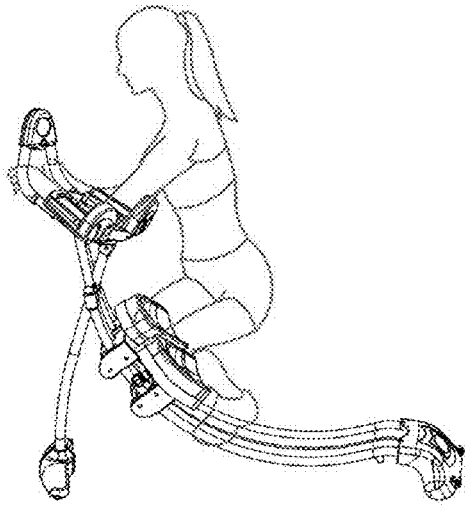
Figure 13A:
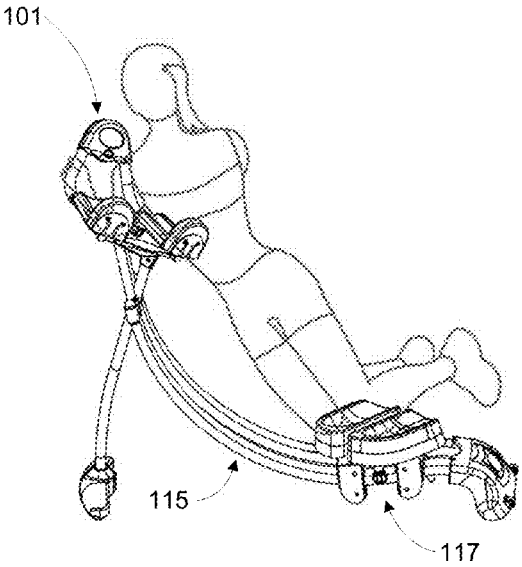
Figure 13B:
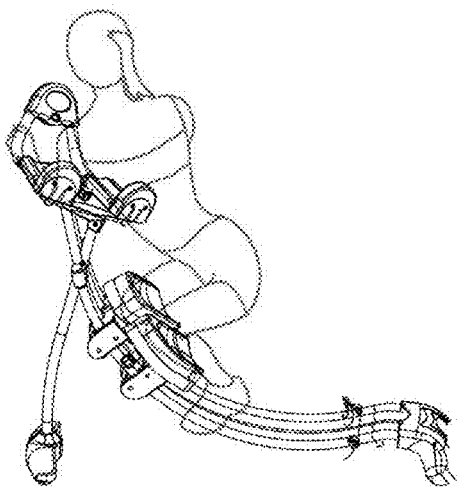

Turning now to FIGS. 10A-10B, armrest holder 101 may be rotated left to form an angular relationship with an intermediate size (e.g. 30 degrees) relative to the longitudinal direction of frame 115. Kneeling pads of kneeling support 117 may be rotated left to from an angular degree with the longitudinal direction of track frame 115. The user may hold on handle bars with arms and elbow resting on armrest holder 101 to cause up and down slide movements along the curvature of track frame 115 with both upper body and lower body twisting effects. Alternatively, turning now to FIGS. 11A-11B, armrest holder 101 may be rotated further left to form a strong angular relationship with an size (e.g. 60 degrees) relative to the longitudinal direction of track frame 115 to increase the twisting effects while moving along the track frame with rotated kneeling pads. FIGS. 12A-12B and 13A-13B may show similar applications of an exercise machine as in FIGS. 10-11 with armrest holder 101 rotated to the right side while kneeling support rotated to the left side. Armrest holder 101 and kneeling pads of kneeling support 117 may be configured to be oriented towards opposite or similar directions (e.g. left and right).

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An exercising machine comprising:

a track frame having a plurality of elongated gliding rails extended between a higher end and a lower end of the track frame;

one or more kneeling assemblies movably mounted on the elongated gliding rails to receive knees from a user to make movements up and down between the lower end and the higher end of the track frame along the elongated gliding rails, wherein the kneeling assemblies are configurable to move together or separately along the elongated gliding rails; and an armrest holder mounted, adjustable rotationally, on the higher end of the track frame, the armrest holder oriented towards a direction having a left right angular relationship with an axis of the track frame between the lower end and the higher end, wherein the armrest holder is capable of supporting arms of the user making the movements with a twisting effect according to the left right angular relationship.

2. The exercising machine of claim 1, wherein the armrest holder comprises:

a handle bar pointed in the direction of the armrest holder, the handle bar to be grabbed by user hands;

two elbow pads arranged in alignment with the handle bar, wherein the elbow pads are shaped to receive resting elbows of the user; and a display indicating an angular value corresponding to the angular relationship between the direction of the armrest holder and the axis of the track frame.

3. The exercising machine of claim 2, wherein the track frame has a binding plate fixedly attached to the gliding rails at the higher end of the track frame, wherein rotational movement of the armrest holder is constrained along a surface corresponding to the binding plate, wherein the axis of the track frame and the direction of the armrest holder forms an angle over the surface, and wherein the display displaying the angular value of the angle.

4. The exercising machine of claim 3, wherein the armrest holder includes a mounting bracket, wherein the handle bar, the elbow pads and the display are fixedly attached to the mounting bracket, wherein the armrest holder has an adjustment fastener and wherein the mounting bracket is adjustable rotationally around a center of the binding plate via the adjustment fastener.

5. The exercising machine of claim 4, wherein the binding plate is configured with a plurality of coupling holes equally spaced circularly around the center, wherein the armrest holder is secured to the binding plate with the adjustment fastener locked through one of the coupling holes.

6. The exercising machine of claim 5, wherein the fastener selects one of a plurality of predetermined sizes for the angle between the axis of the track frame and the direction of the armrest holder, and wherein the predetermined sizes corresponds to the plurality of coupling holes around the center of the binding plate.

7. The exercising machine of claim 1, wherein the gliding rails are curved to allow the movement in more than one dimension.

8. The exercising machine of claim 1, wherein the elongated gliding rails are arranged in parallel between the lower end and the higher end of the track frame, and wherein each kneeling assembly is engaged with one or more of the elongated gliding rails for the movement.

9. The exercising machine of claim 8, wherein the kneeling assemblies include a first kneeling assembly and a second kneeling assembly, wherein the elongated gliding rails include a first pair of gliding rails and a second pair of gliding rails, and wherein the first and second kneeling assemblies are separately engaged with the first and second pairs of gliding rails.

10. The exercising machine of claim 8, wherein each kneeling assembly is separately engaged with a single one of the elongated gliding rails for the movement.

11. The exercising machine of claim 9, where the first kneeling assembly includes a first kneeling pad adjustable rotationally to orient toward a first direction forming a first angle with a first axis of the first pair of gliding rails, wherein the second kneeling assembly includes a second kneeling pad adjustable rotationally to orient towards a second direction forming a second angle with a second axis of the second pairs of gliding rails, wherein the first and second kneeling assemblies provide additional twisting effect for the movement according to the first and second angles.

12. The exercising machine of claim 9, wherein the first and second kneeling assemblies include a coupling control mechanism to detachably couple the first and second kneeling pads, the first and second angles being substantially equal in size for the additional twisting effect.

13. The exercising machine of claim 9, wherein the coupling control mechanism is capable of decoupling the first and second kneeling assemblies for gliding along the first and second gliding rails in opposite directions.

14. The exercise machine of claim 9, wherein the first kneeling assembly includes a first mounting bracket movably mounted on the first pair of gliding rail, wherein the first kneeling pad is adjustably attached to the first mounting bracket via a first surface of the first mounting bracket, wherein the first kneeling pad is capable of rotating with respect to a first rotation axis that is perpendicular to the first surface.

15. The exercising machine of claim 1, further comprising:

a support frame affixed to the higher end of the track frame, the support frame providing elevation from a floor for the higher end of the track frame, wherein the lower end of the track frame rests on the floor.

16. An exercising machine comprising:

a track frame having two pairs of elongated gliding rails in parallel, the track frame having a higher end and a lower end;

a pair of gliding structures movably mounted separately on each pair of the gliding rails, the gliding structures having kneeling pads capable of receiving knees from a user to make movements with the gliding structures gliding along the rails, wherein the kneeling pads are adjustably oriented towards a first direction having a first left right angular relation with an axis of the track frame between the lower end and the higher end;

an armrest holder mounted, adjustable rotationally, on the higher end of the track frame, the armrest holder oriented towards a second direction having a second left right angular relationship with the axis of the track frame, wherein the armrest holder is capable of supporting arms of the user making the movements with a twisting effect according to the first and second left right angular relationships; and a support frame coupled to the higher end of the track frame to provide support from a floor supporting the exercising machine, the support frame causing the track frame to tilt upwards from the floor while the lower end of the track frame rests on the floor.

* * * * *